US005558506A

United States Patent [19]

Simmons et al.

[11] Patent Number: 5,558,506

[45] Date of Patent: Sep. 24, 1996

[54] PNEUMATICALLY SHIFTED RECIPROCATING PUMP

[76] Inventors: John M. Simmons, 605 Slayton; Tom M. Simmons, 504 Slayton, both of Saginaw, Mich. 48603

[21] Appl. No.: 548,847

[22] Filed: Oct. 26, 1995

Related U.S. Application Data

[63] Continuation-in-part of Ser. No. 205,702, Mar. 3, 1994, abandoned.

[51] Int. Cl.[6] ..... F04B 17/00

[52] U.S. Cl. ..... 417/393; 417/394; 137/625.69

[58] Field of Search ..... 417/384, 393, 417/394; 91/230; 137/625.66, 625.69

[56] References Cited

U.S. PATENT DOCUMENTS

| | | | |
|---|---|---|---|
| 1,161,787 | 11/1915 | Nickol . | |
| 2,239,727 | 4/1941 | Mayer | 103/52 |
| 3,081,794 | 3/1963 | Lucien | 137/622 |
| 3,749,127 | 7/1973 | Beeken | 137/625.6 |
| 3,773,083 | 11/1973 | Hague | 137/625.69 |
| 3,791,768 | 2/1974 | Wanner | 417/393 |
| 4,203,571 | 5/1980 | Ruchser | 251/31 |
| 4,496,294 | 1/1985 | Frikker | 417/393 |
| 4,566,867 | 1/1986 | Bazan | 417/393 |
| 4,634,350 | 1/1987 | Credle, Jr. | 417/393 |
| 4,655,378 | 4/1987 | DuFour | 226/23 |
| 4,736,773 | 4/1988 | Perry | 137/625.64 |
| 4,836,756 | 6/1989 | Fukumoto | 417/394 |
| 4,902,206 | 2/1990 | Nakazawa | 417/394 |
| 4,927,335 | 5/1990 | Pensa | 417/393 |
| 4,983,104 | 1/1991 | Kingsford | 417/473 |
| 5,060,694 | 10/1991 | Florida | 137/625.18 |
| 5,174,731 | 12/1992 | Korver | 417/393 |
| 5,222,521 | 6/1993 | Kihlberg | 137/625.69 |
| 5,224,841 | 7/1993 | Thompson | 417/392 |
| 5,238,372 | 8/1993 | Morris | 417/393 |
| 5,308,230 | 5/1994 | Moore | 417/393 |
| 5,326,234 | 7/1994 | Versaw | 417/393 |
| 5,408,292 | 1/1996 | Chevallier | 417/393 |

FOREIGN PATENT DOCUMENTS

| | | | |
|---|---|---|---|
| 62-233485 | 10/1987 | Japan | 417/393 |

*Primary Examiner*—John J. Vrablik
*Assistant Examiner*—Ted Kim
*Attorney, Agent, or Firm*—Prince, Yeates & Geldzahler

[57] ABSTRACT

A pneumatically actuated reciprocating fluid pump and shuttle valve combination is pneumatically shifted by pressurized air that exhausts from a respective pressurized bellows, diaphragm, or piston chamber, as the bellows, etc. nears the end of its pressure stroke (the exhaust stroke of the pumped fluid). This pressurized air exhausts from the bellows chamber via a shifting piston and cylinder mechanism within the bellows chamber that opens the bellows chamber at a specified location or point in the pump pumping cycle. The pressurized air exhaust from the bellows chamber acts on the end of the shuttle valve spool element to shift the spool element to its opposite position, which reverses the application of pneumatic pressure and atmospheric exhaust between the two bellows chambers to actuate the reciprocating pump.

14 Claims, 11 Drawing Sheets

PNEUMATICALLY SHIFTED RECIPROCATING PUMP

CROSS-REFERENCE TO RELATED APPLICATION

This application is a continuation-In-part of U.S. application entitled Pneumatically Shifted Reciprocating Pump, U.S. Ser. No. 08/205,702, filed Mar. 3, 1994, now abandoned.

BACKGROUND OF THE INVENTION

1. Field of the Invention

The present invention relates to a reciprocating fluid pump, and more particularly relates to a reciprocating fluid pump and shuttle valve combination for shifting pneumatic pressure between reciprocating pistons in the pump in order to effect pumping.

2. Description of the Prior Art

Reciprocating pumps are well known in the fluid industry. Such reciprocating fluid pumps are operated by a reciprocating shuttle valve which shifts pressurized air from one pumping chamber of the pneumatic reciprocating pump to the other as the pumping means (piston, bellows, diaphragm, etc.) reaches the end of its pumping stroke. The valve spool in the shuttle valve shifts between two positions which alternately supply pressurized air to the pumping means of one side of the pump while simultaneously permitting the other pumping means to exhaust the air therefrom. The shifting of the valve spool simply alternates this pressurized air/exhaust between pairs of pumping means within the pneumatic pump, thereby creating the reciprocating pumping action of the pump.

In conventional pneumatic reciprocating pump and shuttle valve combinations, the shuttle valves have been shifted mechanically or electronically. In mechanical shifting, the shuttle valve itself is typically constructed as an integral part of the reciprocating pump in a manner such that when the pump piston or diaphragm reaches the end of its pumping stroke, it engages a shift mechanism to mechanically shift the valve spool of the shuttle valve to its opposite position, which reverses the pressurized air and exhaust to the two reciprocating pumping means in order to reverse the direction of both pumping means to cause the just-exhausted fluid chamber to draw fluid thereinto and simultaneously exhaust (pump) fluid from the opposite full fluid chamber.

In electronic shifting of such a pneumatic reciprocating pump, the mechanical shifting means for the shuttle valve is replaced with an electric switch or switches which then activate a solenoid operated shuttle valve for effecting shifting of the valve spool in response to the reciprocating pump pistons', bellows', or diaphragms' having reached the end of their pumping strokes.

A third type of shifting of the shuttle valve is pneumatic shifting, wherein the pump pistons, bellows, diaphragms, etc. engage mechanical or electrical switches at the end of their respective strokes, which shift the supply air pressure to either side of the valve spool for shifting between positions. In the case of electrical switches, these electrical switches actuate solenoid valves which reciprocate the supply air pressure to the shuttle valve. A variation of this pneumatically shifted shuttle valve utilizes pressurized air on both ends of the valve spool, the shifting being effected by the electrical or mechanical switch to release the pressurized air from alternating ends of the valve spool to permit pressurized air at the opposite end to shift the valve spool.

One pneumatically operated reciprocating diaphragm pump on the market today is controlled by a mechanically shifted reciprocating rod that, in turn, causes an internal shuttle valve spool within the pump to shift to alternate the applications of pressurized air and exhaust to opposing diaphragm chambers within the pump. The initial shifting mechanism (reciprocating rod) is mechanical, in that it is shifted by being alternately struck on its ends by the two reciprocating fluid pump diaphragms. The alternating rod removes lateral support from a flexible inner sleeve that permits direct pressurized air to bleed around the sleeve to an end surface of the shuttle valve spool for shifting the shuttle valve spool to its opposite position. Reciprocation of the shuttle valve spool reverses the application of pressurized air and exhaust in the reciprocating pump diaphragm chambers in order to effect pumping of the pump, as is customary in all pneumatically operated dual reciprocating diaphragm or bellows-type pumps that are shuttle valve-actuated.

A similar type of pneumatically actuated reciprocating pump utilizes a shuttle valve incorporated into the pump body, the shuttle valve, of course, for reversing pressurized air and exhaust between the two opposed pumping chambers. The pumping chambers comprise connected diaphragms, which diaphragms alternately engage the end of a shifting rod to reciprocate it between left and right positions. The reciprocating shifting rod alternates air pressure and exhaust between the ends of the valve spool to reciprocate the valve spool. Reciprocation of the shuttle valve spool, of course, operates the reciprocating pump.

There are many problems associated with the currently available pneumatic reciprocating pumps and shuttle valve shifting mechanisms. Mechanical shifting of the spool within the shuttle valve is limited because of available space inside the reciprocating pump, and is also susceptible to premature wear and failure of either the mechanical shifting device for the shuttle valve, the pump diaphragm or piston itself, or both.

The use of electronics or electrical switching of the shuttle valve is prohibited in many situations because of the potential for spark and fire hazards generally associated with electric (i.e., spark generating) switching devices, not to mention the complexity that is introduced by the addition of an electric power supply, electrical switches, and solenoid controlled pneumatic valves.

Some types of pneumatic switching of shuttle valves in reciprocating fluid pump mechanisms are also a potential source of problems. By providing air pressure to both sides of the spool within the shuttle valve, the spool has a natural tendency to locate itself in the exact center of the valve when air pressure to the pump is turned off. When it is again attempted to start the pump, the valve spool, being in the exact center of the shuttle valve, will not direct pneumatic pressure to either side of the valve pumping mechanisms. Therefore, the pump will not be able to start up. This is known in the industry as "deadhead." Deadhead can also occur in mechanical shuttle valve switches whenever switches on both sides of the pump trip during the same stroke. This can be due to a number of reasons including positive fluid pressure through the pump, the presence of a solid material within the pumped fluid, pneumatic leaks, and of course, mechanical switch malfunction. Air in the pumped fluid within the pumping chamber can also create deadhead problems.

It is a further problem of conventional reciprocating fluid pumps and shuttle valve shifting mechanisms that the timing of the shift (the point in the stroke or cycle of the fluid pump in which the air pressure and exhaust in the pumping chambers are reversed) is always set, due to the physical placement of the mechanical or electrical shuttle valve shifting switch. Therefore, it has been impossible to adjust the time of the air pressure actuation of the pump in order for the pump to accommodate the pumping of fluids with different viscosities.

The previously described pneumatically actuated reciprocating diaphragm pump that is actuated by an internal shuttle valve spool is difficult to adjust and control, because of the use of the internal deforming sleeve. The shuttle valve spool is shifted because the plastic sleeve deforms because it loses its lateral support when the control rod shifts. In theory, when air pressure against the sleeve reaches a predetermined amount, the sleeve will deform, eliminating the air pressure seal between the sleeve and shuttle valve spool, causing pressurized air to escape to the end surface of the shuttle valve spool to shift it to its opposite position. Because the deformation of the sleeve is so dependent upon a number of external factors (temperature, humidity, presence of lubricants or other chemicals, etc.), it is extremely difficult to predict when and how much the plastic sleeve will deform, and therefore when and how rapidly the shuttle valve spool will shift. In addition, constant flexure of the plastic sleeve will create material fatigue brittleness, etc. rendering the sleeve valueless for its intended purpose.

Prior art pneumatically actuated reciprocating fluid pumps have also consistently had problems with pumped fluid surge as pumped fluid from one chamber abruptly stops and fluid from the opposite chamber abruptly starts. This surge causes what is termed hydraulic hammering in supply lines, that tends to vibrate the lines, resulting in unnecessary abrasion, flexure, and fatigue in the lines, and also tends to vibrate the fluid connections and fittings loose near the pump. In certain applications, surge can dislodge particulate contamination within fluid filters and reintroduce this contamination into the fluid system.

OBJECTS OF THE INVENTION

It is therefore an object of the present invention to provide a pneumatically shifted reciprocating pump which is virtually immune to deadhead.

It is a further object of the present invention to provide a pneumatically shifted reciprocating pump which eliminates the need for separate electric or mechanical switches for shifting the associated shuttle valve.

It is a still further object of the present invention to provide a pneumatically shifted shuttle valve which operates on air taken from the pressurized side of a pneumatic reciprocating pump to operate the shifting of the shuttle valve, without the requirement for the provision of an additional air supply source.

It is a still further object of the present invention to provide a pneumatically shifted shuttle valve which can be actuated at any predetermined location of the stroke of a reciprocating pump.

It is a still further object of the present invention to provide a pneumatically shifted reciprocating pump having a mechanism for shifting the shuttle valve which is adjustable relative to the precise location of the pump piston or diaphragm within the pump wherein the pneumatic air pressure shifts in order to reciprocate the pump, in order to accommodate pumping fluids of different viscosities.

It is a still further object of the present invention to provide a pneumatically shifted reciprocating fluid pump that eliminates the need for separate electrical or mechanical shifting of the shuttle valve for reciprocating pneumatic air pressure to the reciprocating pump pumping chambers.

It is a still further object of the present invention to provide a pneumatically shifted shuttle valve which may be intertimed and synchronized with multiple shuttle valves or a multiple stage shuttle valve and multiple pumps, or multiple chamber pumps, by overlapping the strokes of reciprocating pumps, in order to reduce the surge inherent in reciprocating pumps.

SUMMARY OF THE INVENTION

A pneumatically shifted reciprocating fluid pump is shifted by a pneumatically shifted shuttle valve, the shuttle valve being shifted to reciprocate the pumping means of the pump by reciprocating pneumatic pressure within the pump. The reciprocating pump shifting mechanism comprises a shifting piston and cylinder mechanism attached to the reciprocating pump piston, bellows, diaphragm, or other pumping element. Reciprocation of the shifting piston within the shifting cylinder exposes shifting ports in respective shifting cylinders to release pressurized air in the associated pump piston chamber or diaphragm bellows chamber to the shuttle valve to shift the shuttle valve spool when the reciprocating pump pumping means (piston, bellows, diaphragm, etc.) reaches a predetermined location in its pumping (evacuation) cycle.

DETAILED DESCRIPTION OF THE INVENTION

Figure 1:
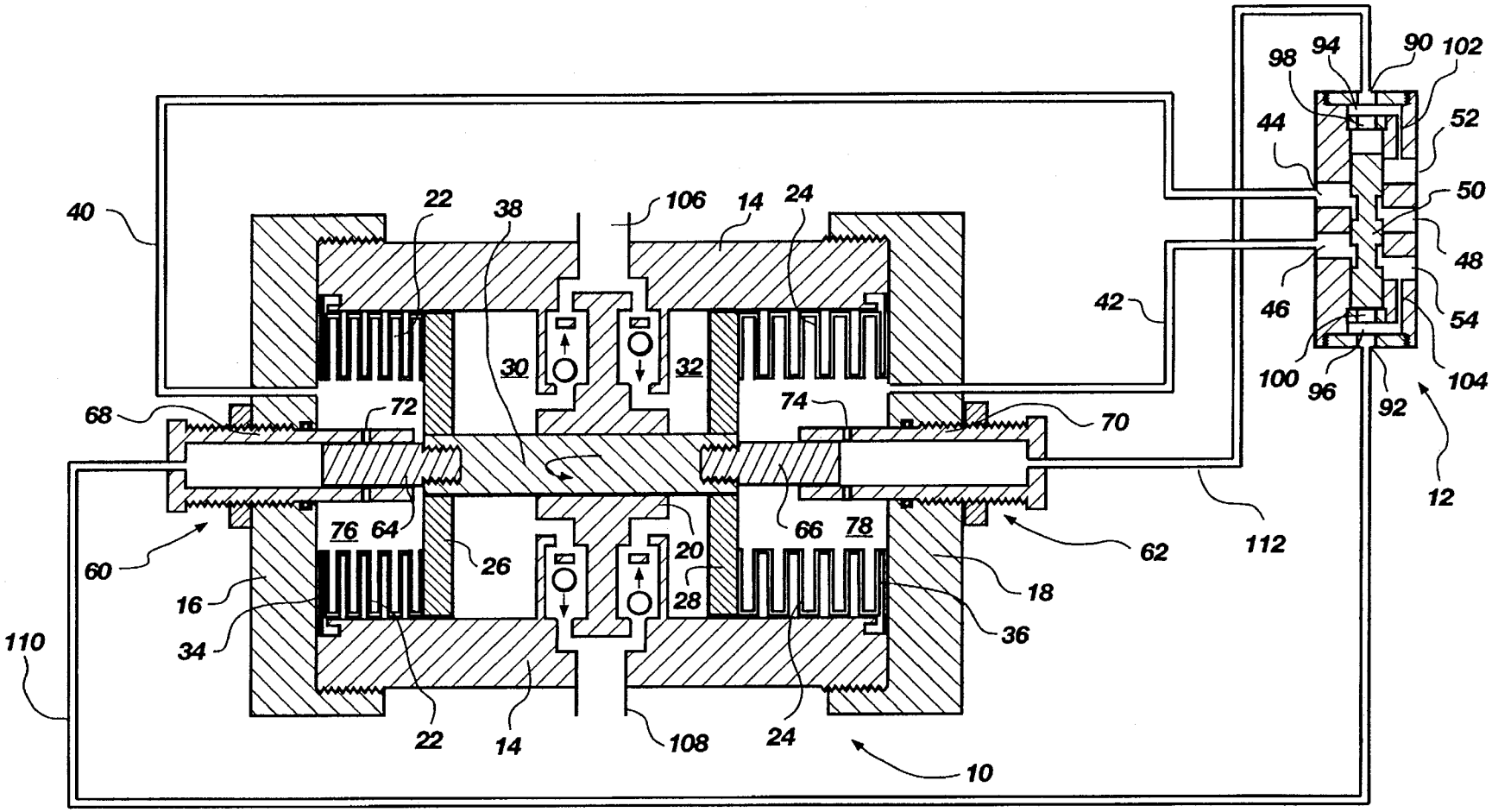
FIG. 1 is a schematic drawing of a first embodiment of the pneumatically shifted reciprocating fluid pump and pneumatically shifted shuttle valve, both shown in section, illustrating the pump and shuttle valve in a first of four sequential pumping cycles.

Turning now to the drawings, and initially to FIG. 1, a pneumatically actuated, dual opposed bellows reciprocating fluid pump 10 and its associated shuttle valve 12 are shown schematically and in section to more easily understand the structure and operation. The reciprocating fluid pump 10 is, in essence, a conventional, 4 cycle, 2 stroke, dual reciprocating bellows pump actuated by pneumatic positive air pressure. The fluid pump comprises a housing 14 to which are attached respective left- and right-end end caps 16, 18. The pump housing 14 also includes a central section 20 that includes the unidirectional flow mechanisms for admitting the fluid to be pumped into the fluid pump and directing the pumped fluid out of the pump. These unidirectional flow mechanisms are shown schematically as floating ball-type check valves, but, of course, may be any form of unidirectional flow mechanism that functions to channel pumped fluid in one direction through the fluid pump. For purposes of reference, fluid flow through the fluid pump 10 is from bottom to top in the drawings.

The fluid pump 10 includes identical, reciprocating left and right bellows 22, 24, respectively, that are attached to respective left and right fluid pumping pistons 26, 28. These respective pistons 26 and 28, in combination with the pump central section 20, define respective left and right fluid pumping chambers 30 and 32. The ends of the bellows opposite the pistons (the outboard ends) are illustrated at 34 and 36, respectively, and are attached to the outboard ends of the fluid pump housing 14 at respective left and right end caps 16 and 18, in a manner to form effective fluid seals between the respective bellows ends and fluid pump housing/end cap attachments. The two fluid pumping pistons 26, 28 are connected together by a connecting rod 38 which enables the pistons to slide and reciprocate together within the fluid pump housing in a customary manner.

The fluid pump is actuated by pneumatic pressure provided by respective left and right pneumatic air fill lines 40 and 42, which alternately introduce pressurized air into the left and right bellows chambers from the shuttle valve 12 in a timed fashion to alternately expand the bellows to provide the reciprocating fluid pumping action of the pump. This alternating pneumatic pressure is provided through the shuttle valve 12 to respective left and right pneumatic air supply ports 44 and 46.

Figure 5:
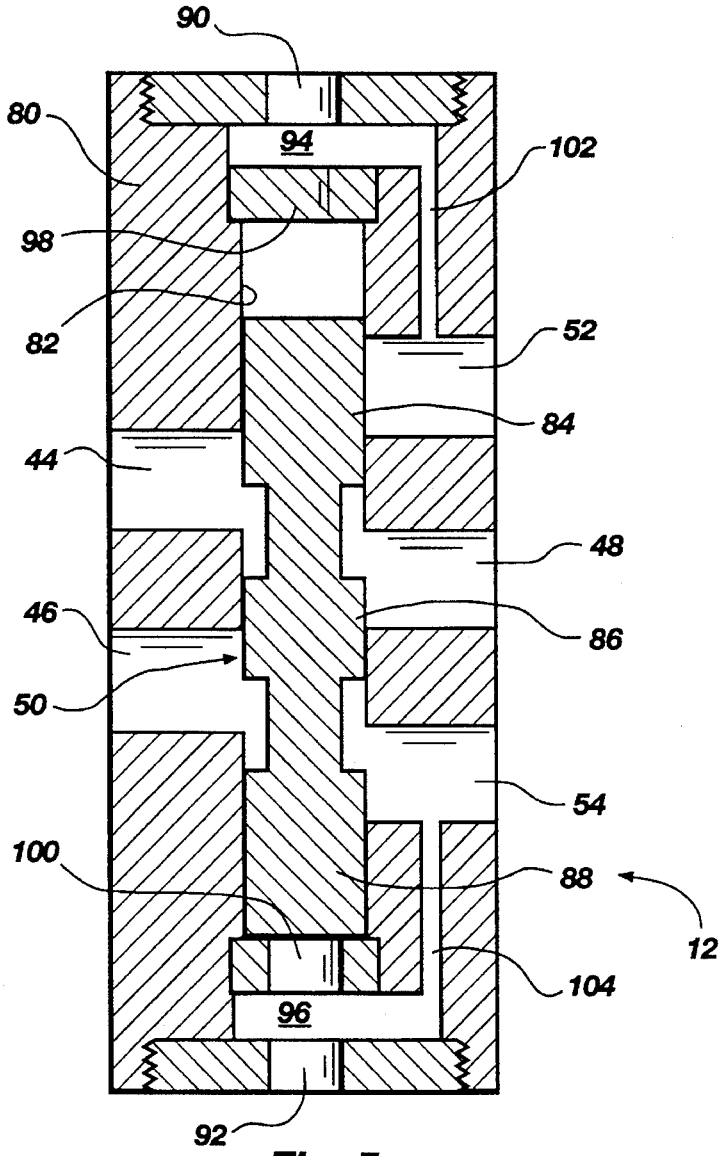
FIG. 5 is a sectional view of the reciprocating shuttle valve for use with the pneumatically shifted reciprocating fluid pump of the present invention.

The shuttle valve (more clearly shown in FIG. 5) directs pneumatic air pressure from an air inlet port 48 alternately between the upper and lower air supply ports 44, 46 by the action of the shuttle valve spool 50 alternately shifting between its upper and lower positions. In addition, the shuttle valve includes respective upper and lower exhaust ports 52, 54, which are adapted to exhaust air from the chamber of the bellows being compressed at the same time that air pressure is being fed to the opposite bellows chamber to expand same. This reciprocating pressurized air supply and exhaust is performed by the shuttle valve in a customary manner.

The foregoing is a brief description of a conventional pneumatically actuated reciprocating pump and associated shuttle valve for alternately shifting the pneumatic air supply and exhaust between the two bellows chambers in order to reciprocate the two pistons within the pump to effect the pumping of fluid through the pump.

The present invention is directed to a novel mechanism for reciprocating the shuttle valve spool 50 in order to operate the pneumatically actuated fluid pump. Referring again to FIGS. 1–4, the invention comprises the addition of respective left and right shifting piston and cylinder mechanisms 60 and 62 to respective fluid pumping pistons 26, 28 and pump housing end caps 16, 18. These shifting mechanisms comprise respective left and right shifting pistons 64 and 66 that reciprocate within respective left and right shifting cylinders 68 and 70. As shown, respective shifting pistons 64, 66 are connected to respective fluid pumping pistons 26, 28 in order to travel linearly therewith. Also, of course, respective shifting pistons 64, 66 reciprocate within respective shifting cylinders 68, 70 in order to effect timed reciprocation of the shuttle valve spool 50 to cause the shuttle valve air supply to actuate the reciprocating fluid pump.

Each shifting cylinder includes respective shifting ports, 72 on the left and 74 on the right, that are exposed during part of the strokes of the shifting pistons 64, 66, in order to permit pressurized air from within respective bellows chambers 76, 78 to "blast" into the interior of respective shifting cylinders 68, 70. As will be explained in greater detail hereinbelow, each time pressurized air is admitted into a shifting cylinder 68 or 70, this air pressure functions to shift the shuttle valve spool 50 to its opposite position within the valve, in order to shift (i.e., reverse) the applications of pneumatic pressure and exhaust between the interiors of respective bellows chambers 76 and 78.

Turning again to FIG. 5, the shuttle valve 12 is shown for use with the pneumatically actuated reciprocating fluid pump. The shuttle valve 12 comprises a valve body 80 defining the upper and lower air supply ports 44, 46, air inlet port 48, and upper and lower exhaust ports 52, 54. The shuttle valve spool 50 reciprocates within a spool bore 82 in a customary manner. The shuttle valve spool 50 includes three valve elements 84, 86, and 88, that function in a customary manner to reciprocate the air pressure and exhaust between respective air supply ports 44, 46, and therefore between the fluid pump bellows chambers. The spool specifically is loose-fitting within the valve body, sufficient to permit a slight amount of pressurized blow-by around the three valve elements, for purposes to be explained in greater detail hereinbelow. As is customary, the valve spool center element 86 reciprocates over the air inlet port 48 to alternately direct pressurized air between the exhaust ports 52, 54. The width of the center element 86 is slightly less than the diameter of the air inlet port 48, however, to eliminate the possibility of the valve element's fully covering the inlet port if the spool 50 comes to rest in the precise center of the valve when the pump is shut down. In this manner, when pressurized air is reintroduced to the shuttle valve inlet port 48 to restart the pump, pressurized air always passes around the center element to one or the other air supply ports 44, 46, to restart the pump, and deadhead in the shuttle valve is thereby always avoided.

In addition, the inventors have determined that, by orienting the shuttle valve in a vertical orientation as shown in the drawings, the shuttle valve spool 50, always drops to the bottom of the valve body 80 when actuation air pressure at the inlet port 48 is terminated. In this manner, gravity causes the shuttle valve to reset to the same operable position upon shutdown, whereby pressurized air subsequently introduced at the shuttle valve air inlet port 48 will always pass around the valve spool 50, through the upper air supply port 44 and into the pump left bellows chamber, to initiate pumping of the fluid pump. Because of the gravity reset of the shuttle valve spool 50, deadhead in the shuttle valve, and therefore the fluid pump, is always avoided.

The shuttle valve 12 also includes respective upper and lower shifting ports 90, 92 which are adapted to receive alternate blasts of pressurized air in order to reciprocate the shuttle spool within the valve. These shifting ports 90, 92 communicate with respective air chambers 94, 96 which in turn, communicate with respective upper and lower spool ports 98, 100. As shown, each air chamber 94 and 96 also communicates with a respective upper and lower shuttle valve exhaust port 52, 54, through a respective exhaust bleed passageway 102, 104, the purpose of which will be explained in greater detail hereinbelow with reference to the operation of the reciprocating fluid pump.

OPERATION

With reference now again to FIGS. 1–4, the operation of the reciprocating fluid pump of the present invention will be explained. FIG. 1 illustrates the first stage or cycle of the pump and shuttle valve. The shuttle valve spool 50 is shown in its lower position, having dropped within the valve body 80 under the force of gravity when air pressure is interrupted. High pressure air is introduced to the shuttle valve at the air inlet port 48, and passes through the valve to the upper air supply port 44, through the left air fill line 40, and into the left bellows chamber 76. At this point, the left bellows 22 is essentially compressed and the bellows chamber 76 is otherwise sealed except for its communication with the left air fill line 40. The left bellows chamber 76 begins to fill under pneumatic pressure to expand, urging both fluid pumping pistons 26, 28 to the right. This is the pressure stroke of the left bellows and exhaust stroke of the right bellows. This is shown in FIG. 2, which illustrates the second stage or cycle of the pump and shuttle valve.

Figure 2:
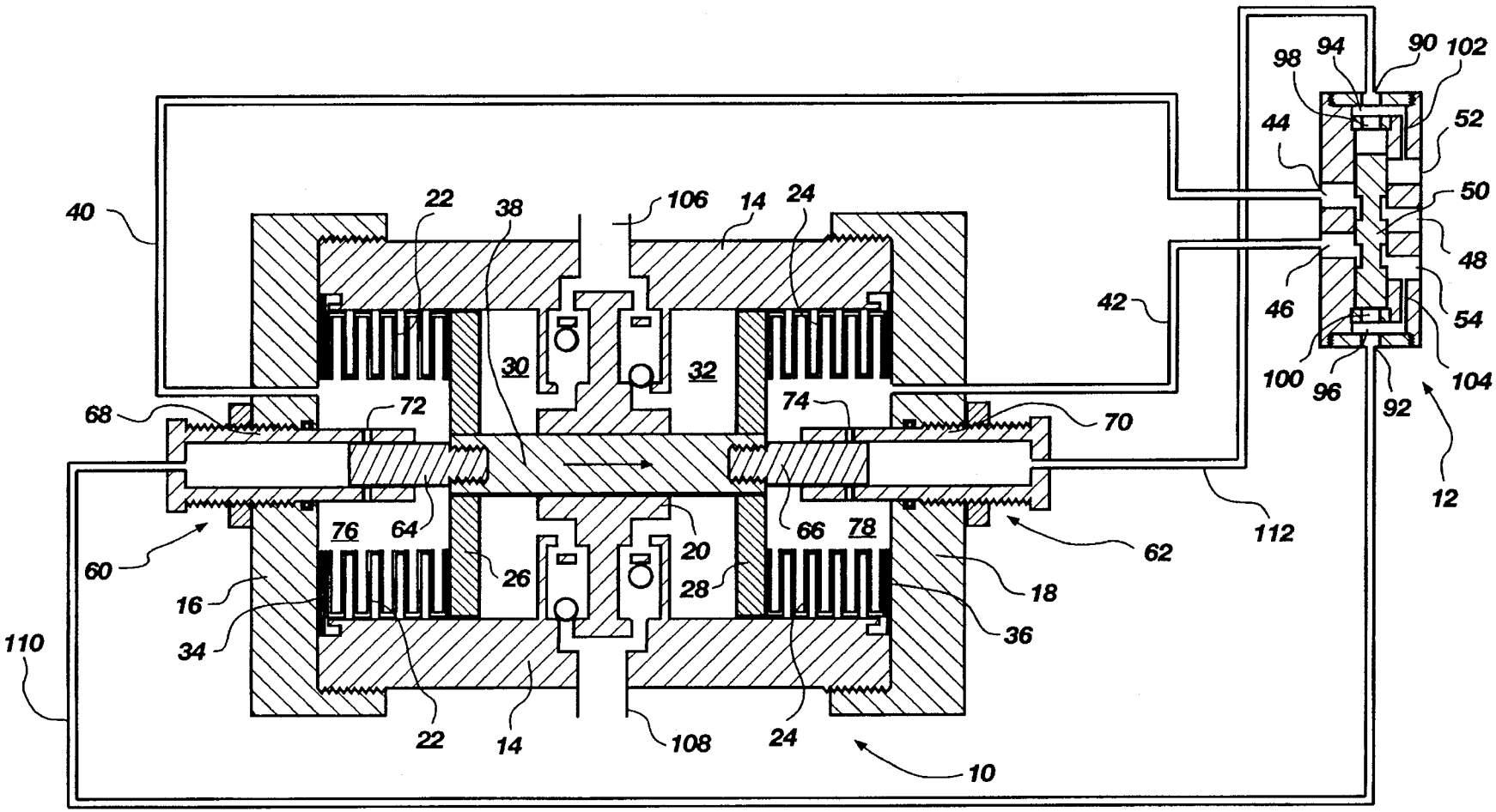
FIG. 2 is a schematic drawing similar to FIG. 1, illustrating the pump and shuttle valve in the second stage of the cycle.

As shown in FIG. 2, the shuttle valve spool 50 remains in its lower position. Rightward movement of the left fluid pumping piston 26 evacuates (pumps) fluid from the left fluid pumping chamber 30, and out the fluid pump exhaust 106. Rightward movement of the right fluid pumping piston 28 draws fluid into the right fluid pumping chamber 32 via the fluid pump intake 108. Rightward movement of the right fluid pumping piston 28 also evacuates the right bellows chamber 78 through the right air fill line 42, the shuttle valve lower air supply port 46, through the shuttle valve, and out the lower exhaust port 54, to atmosphere.

Rightward travel of the left shifting piston 64 with the pumping pistons 26, 28 and connecting rod 38 causes a vacuum to be created within the left shifting cylinder 68. This vacuum is applied through a left shifting line 110 to the shuttle valve lower shifting port 92, air chamber 96, and spool port 100, tending to maintain the spool 50 at the bottom of the valve body as shown.

As the left shifting piston 64 travels to the right within its shifting cylinder 68, it uncovers the left shifting ports 72, thereby permitting a blast of pressurized air in the left bellows chamber 76, which is in its pressure stroke, to exhaust through the shifting ports 72 and into the interior of the left shifting cylinder 68. This blast of pressurized air exhausts from the left shifting cylinder 68 through the left shifting line 11 0, the lower shuttle valve shifting port 92, and through the lower air chamber 96 and spool port 100, where it "blasts" the shuttle valve spool 50 to its upper position. This "shifts" the shuttle valve and fluid pump to their third stage or cycle, as is shown in FIG. 3.

Figure 3:
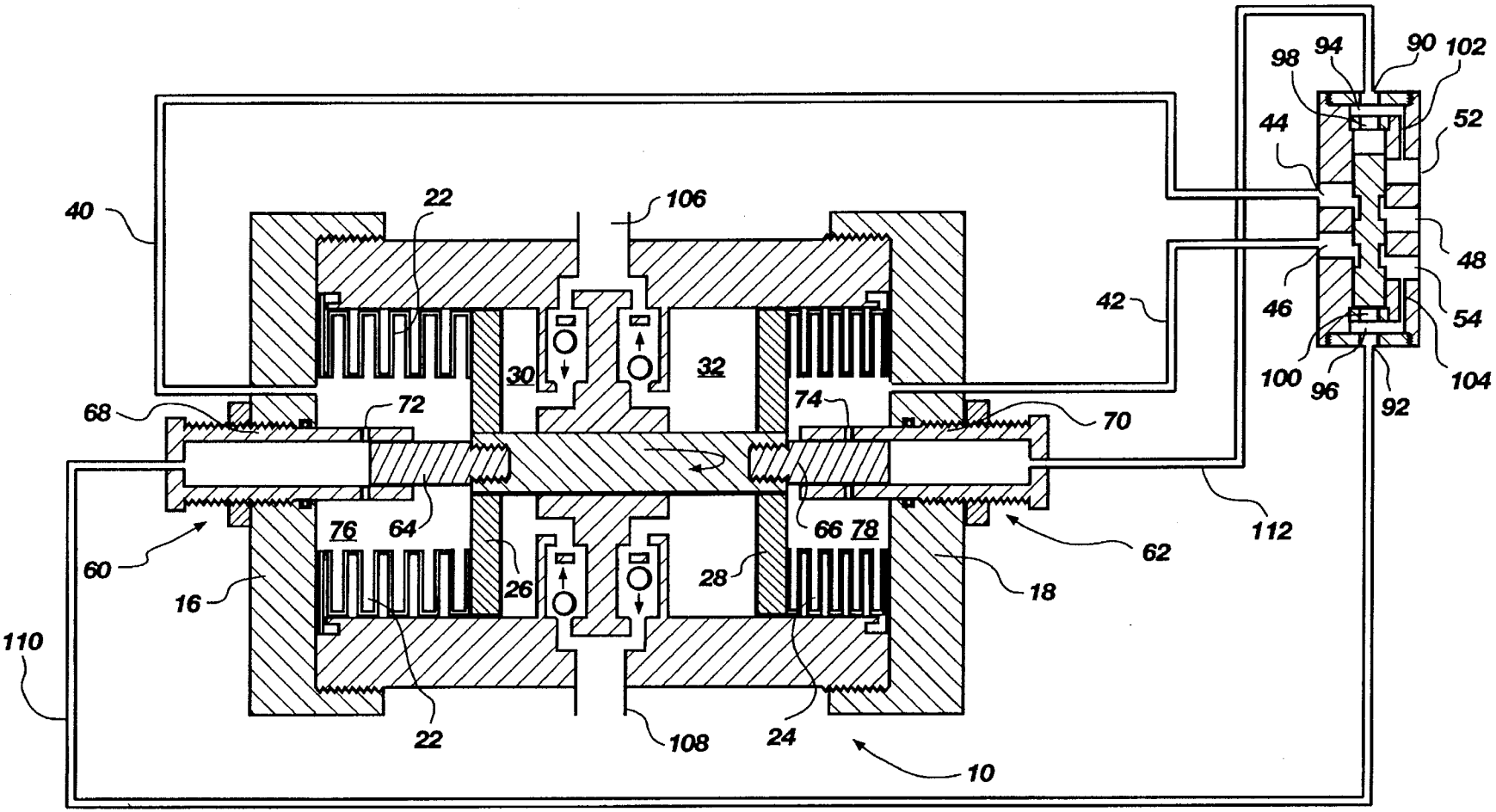
FIG. 3 is a schematic drawing similar to FIGS. 1 and 2, illustrating the pump and shuttle valve in the third stage of the cycle.

In FIG. 3, further pressurized air in the shuttle valve lower air chamber 96 bleeds through the lower exhaust bleed passageway 104 and out the lower exhaust port 54. Because of the restrictive orifice effect of the shuttle valve exhaust bleed passageway 104, this initial blast of pressurized air into the shuttle valve lower shifting chamber 96 is forced into the larger spool port 100 to shift the spool 50 from its lower position to its upper position, before the residual pressurized air is permitted to "bleed" to exhaust through the restrictive exhaust bleed passageway 104 and exhaust port 54.

In addition, pressurized air passing through the shuttle valve lower spool port 100 is also permitted to bleed around the valve element 88, and out the lower exhaust port 54 to atmosphere. The purpose of these two pressurized air bleeds is to effect a drop in air pressure applied to each end of the shuttle valve spool as the shuttle valve spool nears the end of each respective operative stroke. This reduction in air pressure near the end of the operative stroke permits air in the opposite chamber adjacent the spool port (in this case the upper spool port 98) to provide a cushioning effect to the valve spool to prevent the valve spool from slamming against the respective ends of the shuttle valve body.

With the shuttle spool 50 in its upper position (FIG. 3), high pressure air through the inlet port 48 is now directed to the lower air supply port 46, through the right air fill line 42, and into the right bellows chamber 78. At this point, the right bellows 24 is essentially compressed and the bellows chamber 78 is otherwise sealed except for its communication with the right air fill line 42. The right bellows chamber 78 begins to fill under pneumatic pressure to expand, urging both fluid pumping pistons 28, 26 to the left. This is the pressure stroke of the right bellows and exhaust stroke of the left bellows. This is shown in FIG. 4, which illustrates the fourth stage or cycle of the pump and shuttle valve.

Figure 4:
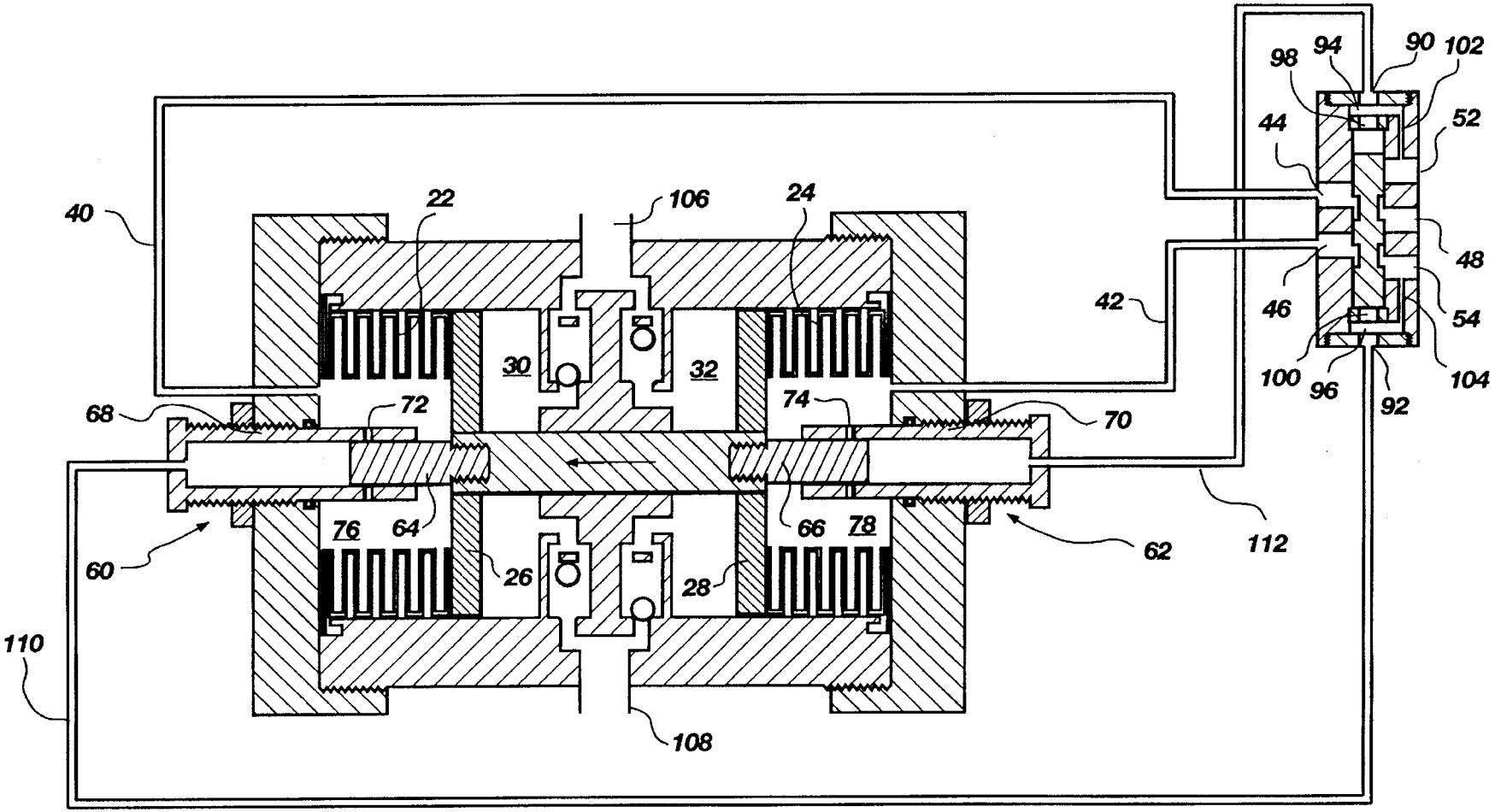
FIG. 4 is a schematic drawing similar to FIGS. 1–3 , illustrating the pump and shuttle valve in the fourth stage of the cycle.

As shown in FIG. 4, the shuttle valve spool 50 remains in its upper position. Leftward movement of the right fluid pumping piston 28 evacuates (pumps) fluid from the right fluid pumping chamber 32, and out the fluid pump exhaust 106. Leftward movement of the left fluid pumping piston 26 draws fluid into the left fluid pumping chamber 30 via the fluid pump intake 108. Leftward movement of the left fluid pumping piston 26 also evacuates the left bellows chamber 76 through the left air fill line 40, the shuttle valve upper air supply port 44, through the shuttle valve, and out the upper exhaust port 52, to atmosphere.

Leftward travel of the right shifting piston 66 with the pumping pistons 26, 28 and connecting rod 38 causes a vacuum to be created within the right shifting cylinder 70. This vacuum is applied through a right shifting line 112 to the shuttle valve upper shifting port 90, air chamber 94, and spool port 98, tending to maintain the spool 50 in its upper position as shown.

As the right shifting piston 66 travels to the left within its shifting cylinder 70, it uncovers the right shifting ports 74, thereby permitting a blast of pressurized air in the right bellows chamber 78 to exhaust through the shifting ports 74 and into the interior of the right shifting cylinder 70. This blast of pressurized air exhausts from the right shifting cylinder 70 through the right shifting line 112, the upper shuttle valve shifting port 90, and through the upper air chamber 94 and spool port 98, where it "blasts" the shuttle valve spool 50 to its lower position. This "shifts" the shuttle valve and fluid pump back to their first stage or cycle, as is shown in FIG. 1.

Returning to FIG. 1, further pressurized air in the upper shuttle valve air chamber 94 bleeds through the upper exhaust bleed passageway 102 and out the upper exhaust port 52. Because of the restrictive orifice, effect of the shuttle valve exhaust bleed passageway 102, this initial blast of pressurized air into the shuttle valve upper shifting chamber 94 is forced into the larger spool port 98 to shift the spool 50 from its upper position to its lower position, before the residual pressurized air is permitted to "bleed" to exhaust through the restrictive exhaust bleed passageway 102. At this point in the cycle, the cycle repeats itself with the description of the FIG. 1 first stage of the cycle.

Figure 6:
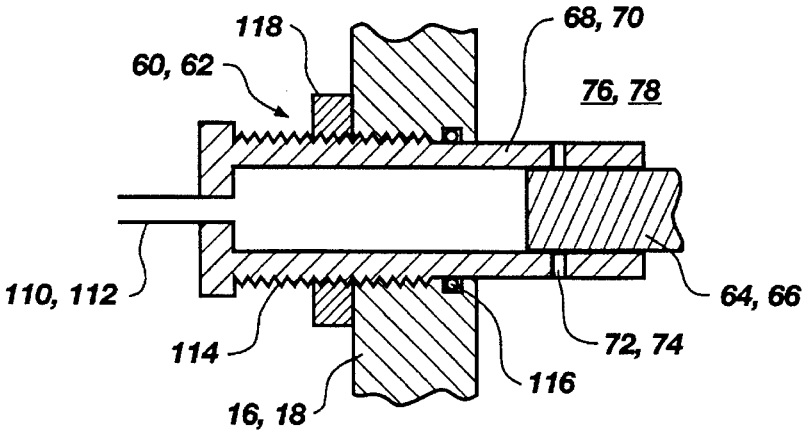
FIG. 6 is a sectional view through a portion of one end cap of the reciprocating pump of the present invention, illustrating the shifting piston and cylinder mechanism for switching the pneumatic actuating air pressure alternately between the two pumping chambers.

FIG. 6 illustrates the shifting piston and cylinder mechanism for switching the pneumatic actuation pressure alternately between the left and right ends of the shuttle valve spool 50. Although the left shifting piston and cylinder mechanism 60 is shown, it will be understood that the left and right mechanisms are identical, and that the operation procedure explanation applies to both.

Cylinder 60 includes the plurality of circumferentially spaced shifting ports 72 that are designed to permit pressurized air from within the bellows chamber 76 to be introduced to the interior of the cylinder at a specified location in the rightward direction stroke of the shifting piston 64, at the approximate end of the strokes of the fluid pumping pistons. Depending on a number of factors (i.e., viscosity of the pumped fluid, supply air pressure and volume flow rate, etc.), the actual point at which it is desired for the shuttle valve to shift should be adjustable, in order to prevent the fluid pumping pistons from slamming into the central section 20 of the fluid pump housing, for instance. This adjustability is accomplished by relocating the shifting ports 72 relative to the pump housing end cap 16, thereby shifting the location of the fluid pumping piston within its stroke, at which the actuation pneumatic pressure within the bellows chamber is reversed to the opposite bellows chamber to reciprocate the fluid pumping pistons. This adjustment is accomplished by providing a screw-threaded connection 114 between the shifting cylinder 68 and fluid pump end cap 16, such that relocating the shifting cylinder relative to the end cap moves the point at which the fluid pumping pistons will "reciprocate." For example, screwing the shifting cylinder (and therefore the shifting ports) further into the bellows chamber (to the right in FIG. 6), shifts the "reciprocation point" of the pumping pistons to increase the stroke of the adjacent pumping piston (the left chamber 26, for instance) to increase the volume of fluid evacuated, while increasing the intake stroke of the opposite pumping piston (the right piston 28) to increase the volume of fluid drawn into the pump. This is accomplished simply by screwing the intake cylinder 68 further through the end cap into the bellows chamber.

Likewise, retracting the shifting cylinder from the bellows chamber will cause the reciprocal switching to occur sooner in the exhaust stroke of the fluid pump, and also, of course, decrease the stroke of the opposite pumping piston and therefore the volume of fluid drawn into the pump in its intake stroke.

Inasmuch as the fluid seal between the end cap and the shifting cylinder must remain intact, and because of the fact that the screw threads 114 are not sealing threads, an O-ring seal 116 is provided between the outer section of the shifting cylinder 68 and the end cap 16. In addition, securing nut 118 is provided to tighten down against the end cap to secure the shifting cylinder in its adjusted position relative to the end cap.

It will be appreciated that the present invention offers a number of improvements over pneumatically actuated dual reciprocating fluid pumps of the prior art. In the pump of the present invention, pneumatic pressure for shifting the reciprocating shuttle valve is taken from the pressure side, or pressure stroke, of the bellows pumping cycle. This has a number of advantages over prior art pneumatically actuated fluid pumps. Specifically, taking pneumatic pressure from the bellows pumping stroke permits the bellows chamber to begin to bleed air pressure therefrom, a predetermined amount prior to the end of the physical stroke of the bellows and fluid pumping pistons. This has a cushioning effect at the end of each fluid pumping piston stroke by reducing the pneumatic pumping pressure slightly, immediately prior to the shift of the actuation pneumatic pressure from one bellows chamber to the other.

The fit between the shifting piston and cylinder is sufficiently loose that a small amount of pressurized air is permitted to bleed between the piston and cylinder. This has the effect of further dropping the shifting air pressure in the bellows near the end of the mechanical stroke of each fluid pumping piston. This results in further reducing the pneumatic pumping pressure, immediately prior to the shift of the actuation pneumatic pressure from one bellows chamber to the other, thereby minimizing "slamming" of each bellows and fluid pumping piston into the fluid check valve mechanism in the center of the fluid pump.

In addition, the opposite shifting piston and cylinder mechanism is under a controlled air pressure resistance as air is permitted to bleed from the cylinder through the respective shuttle valve restrictive exhaust bleed passageway, thereby providing an air pressure cushioning or air brake effect which also helps slow the piston and bellows travel near the end of the stroke, in order to eliminate, or at least reduce, detrimental effects of the piston's positive shifting into the reverse direction at the end of its stroke. This elimination or reduction of the piston's slamming into the fluid pump housing central section and the bellows' being over compressed results in much smoother shifting and reciprocation of the fluid pumping pistons within the pump, and also reduced wear and fatigue on the pump components. In addition, the air cushion or air braking effect provided by both the pressure stroke bellows chamber's releasing air pressure toward the end of its stroke, and the back pressure provided by the exhaust stroke bellows chamber's controlled air pressure bleed therefrom, virtually eliminates fluid surge in the pump.

Certain applications of reciprocating fluid pumps dictate that the pump (or at least all surfaces exposed to the pumped fluid) be constructed totally of Teflon or other fluroplastic materials that are not susceptible to chemical damage. The fluid pump of the present invention is designed to be constructed entirely of Teflon or other soft material which does not require lubrication. In addition, certain components may be constructed of metal or other harder materials, as in many conventional pumps.

Inasmuch as the shuttle valve air inlet port can never be fully blocked, pneumatic pressure is always available through the shuttle valve. Therefore, deadhead is eliminated in the arrangement of the present invention, by virtue of the fact that there is always the flow of pressurized air through the shuttle valve to the reciprocating pump.

ALTERNATIVE EMBODIMENT

FIGS. 7–12 illustrate an alternative embodiment of the pneumatically shifted reciprocating fluid pump and its associated shuttle valve. The theory of the alternative embodiment pump and shuttle valve is the same as that of the first embodiment, with the following differences in the fluid pump and shuttle valve. The fluid pump of FIGS. 7–10 incorporates an alternative design to the housing end caps. The shuttle valve (more clearly shown in FIG. 11) incorporates a spool having four valve elements, rather than three of the first embodiment shown in FIG. 5. Inasmuch as the remaining structural elements of the fluid pump and shuttle valve are identical to those shown in FIGS. 1–5, they will be indicated by the same reference numerals used in those figures and previously in this description.

In FIGS. 7–10, the fluid pump incorporates an alternative design left and right side end cap 122, 124 that incorporate respective left and right shifting cylinders 124, 126 therein. As in the previous embodiment shown in FIGS. 1–5, the shifting pistons 64, 66, reciprocate within the respective shifting cylinders 124, 126, as previously described.

The embodiment of FIGS. 7–11 incorporates an alternative design to the shifting ports within the respective shifting cylinders. In this embodiment, the respective shifting cylinders 124, 126 include sets of pluralities of left and right air release holes 128, 130 that communicate with respective left and right annular channels 132, 134 to define the shifting ports, or point at which pressurized air from within the bellows chambers 76, 78 "blasts" into the interiors of respective shifting cylinders 124, 126. The inventors have determined that this particular arrangement of air release holes and annular channel functions more efficiently in certain conditions to permit a larger and faster blast of pressurized air from the bellows chamber into the shifting cylinder for purposes of shifting the shuttle valve spool.

Figure 9:
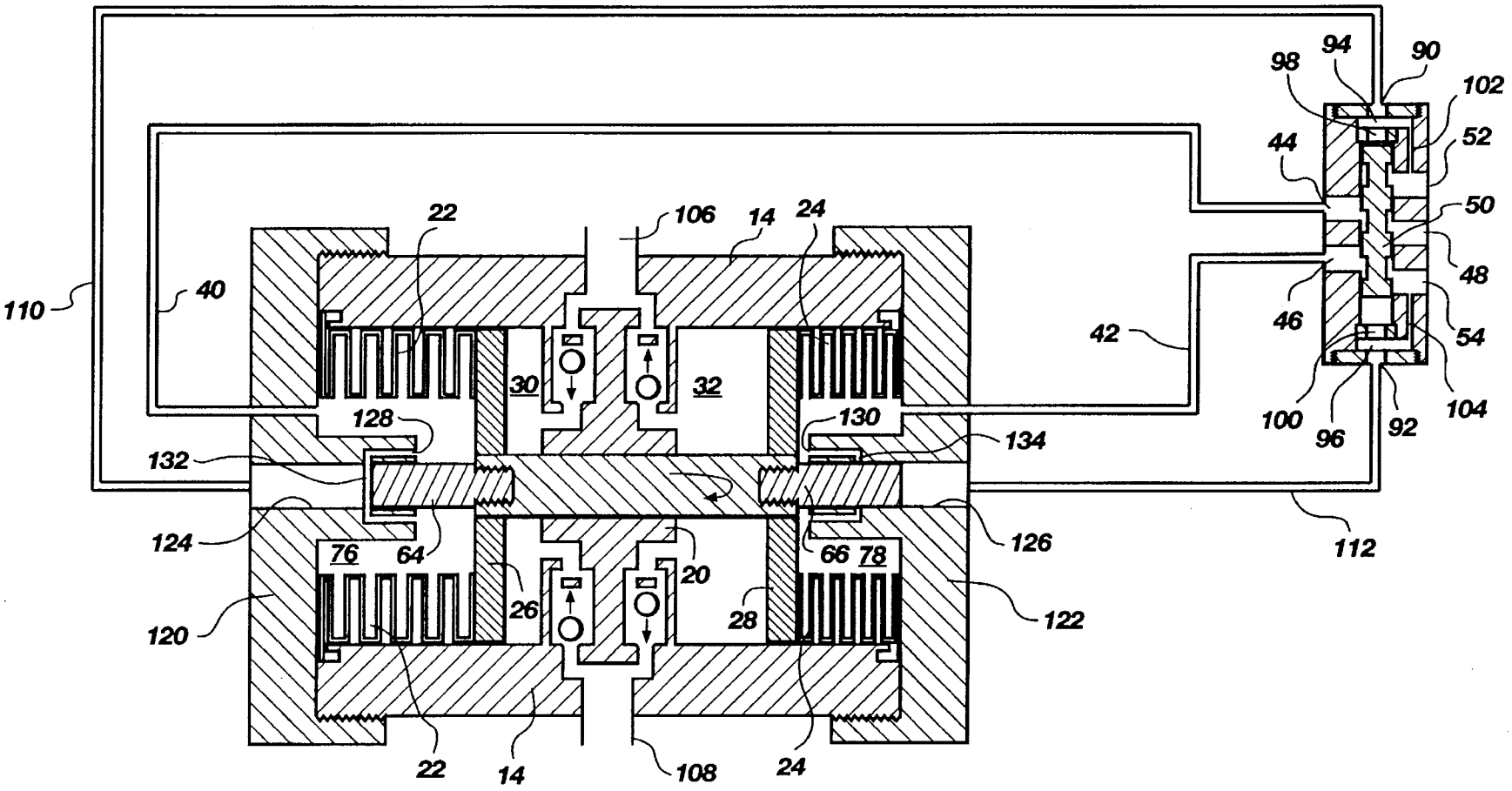
FIG. 9 is a schematic drawing similar to FIGS. 7 and 8, illustrating the pump and shuttle valve in the third stage of the cycle.
Figure 10:
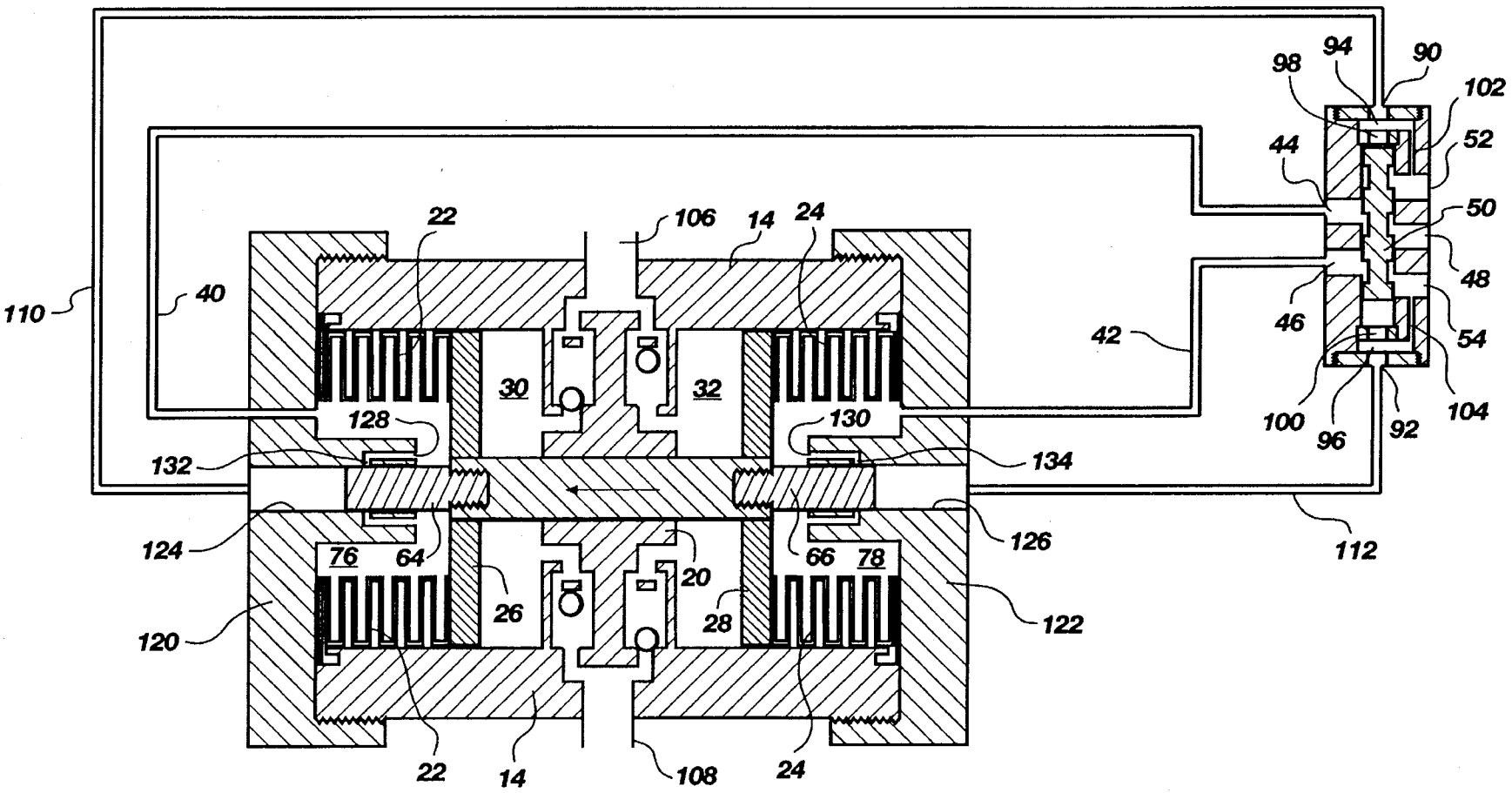
FIG. 10 is a schematic drawing similar to FIGS. 7–9, illustrating the pump and shuttle valve in the fourth stage of the cycle.
Figure 11:
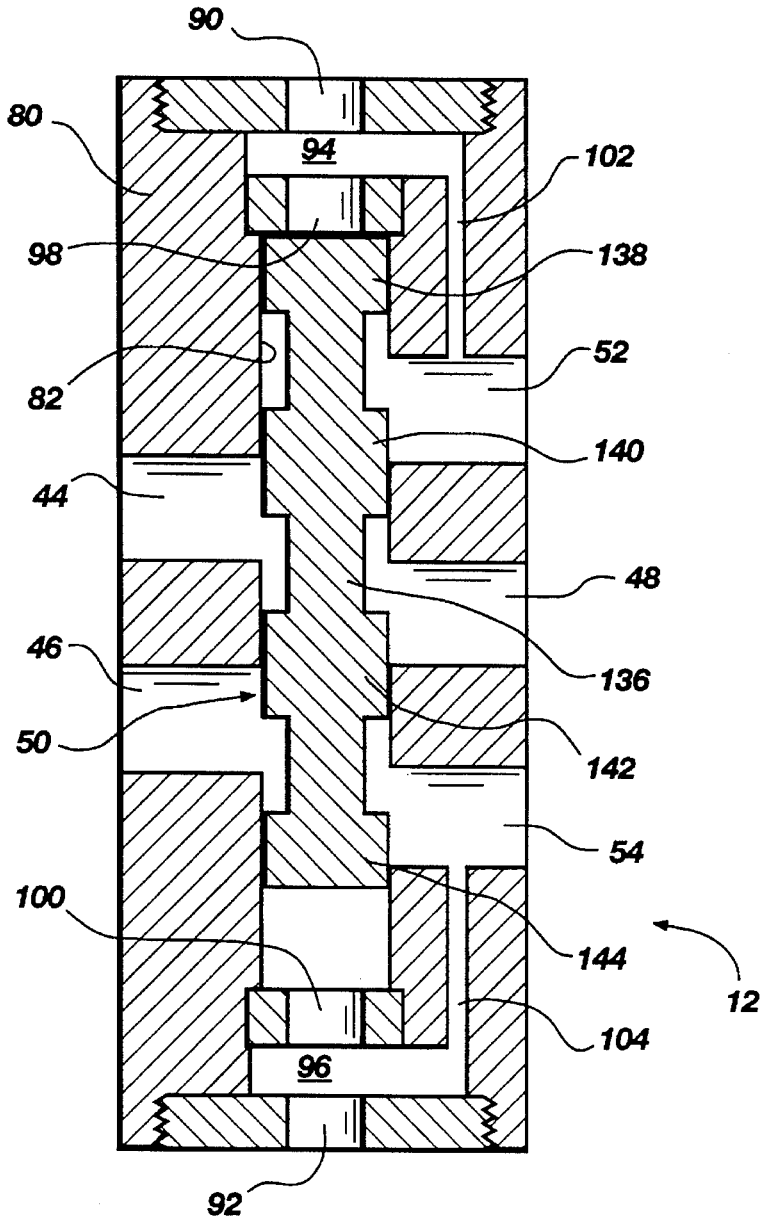
FIG. 11 is a sectional view of the alternative embodiment reciprocating shuttle valve for use with the alternative embodiment pneumatically shifted reciprocating fluid pump.

Turning to FIG. 11, the alternative embodiment shuttle valve is shown for use with the fluid pump of FIGS. 7–10. As in the first embodiment, the shuttle valve comprises a valve body 80 defining the upper and lower air supply ports 44, 46, air inlet port 48, and upper and lower exhaust ports 52, 54. This embodiment includes a modified shuttle valve spool 136 that reciprocates within the spool bore 82 in a customary manner. This modified shuttle valve 136 includes four valve elements 138, 140, 142, 144. In this alternative design, the two center valve elements 140 and 142, replace the center valve element in the first embodiment shuttle valve 12. The shuttle valve of FIG. 11 functions similarly to the shuttle valve of FIG. 5, with the exception that, to shift the pressurized air flowing through the valve and out the upper air supply port 44 to the lower air supply port 46, the valve spool 136 must be shifted from its upper position to its lower position by a blast of pressurized air acting at the upper valve shifting port 90, rather than at the lower valve shifting port 92. This is reversed from the shuttle valve of FIG. 5. Likewise, in order to shift the flow of pressurized air through the shuttle valve from the lower air supply port 46 to the upper air supply port 44, the shuttle valve spool 136 is shifted from its lower position to its upper position by a blast of pressurized air at the lower shifting port 92, rather than at the upper shifting port 90. This reversal of the application of blasts of high pressure air to shift the shuttle valve spool is reflected in the configuration of air flow lines in FIGS. 7–10, in which the respective connections to the shuttle valve shifting ports of the pump air fill lines 40, 42, are reversed from what is shown in FIGS. 1–4.

OPERATION

Figure 7:
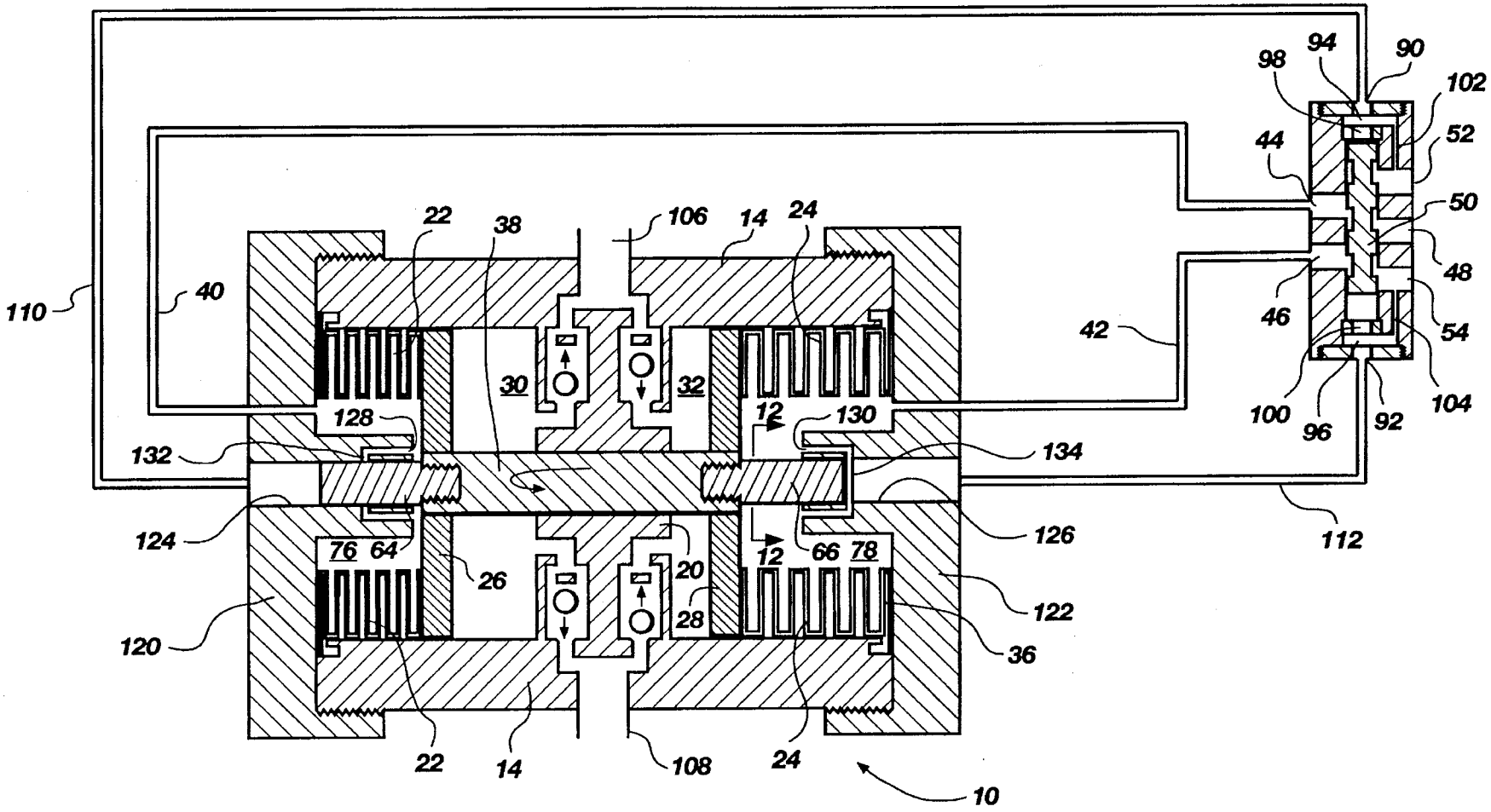
FIG. 7 is a schematic drawing of alternative embodiments of the pneumatically shifted reciprocating fluid pump and pneumatically shifted shuttle valve, both shown in section, illustrating the pump and shuttle valve in a first of four sequential pumping cycles.

With reference now again to FIGS. 7–10, the operation of the alternative embodiment reciprocating fluid pump and shuttle valve will be explained. FIG. 7 illustrates the first stage or cycle of the pump and shuttle valve. The shuttle valve spool 136 is shown shifted to the upper. High pressure air is introduced to the shuttle valve at the air inlet port 48, and passes through the valve to the upper air supply port 44, through the left air fill line 40, and into the left bellows chamber 76. At this point, the left bellows 22 is essentially compressed and the bellows chamber 76 is otherwise sealed except for its communication with the left air fill line 40. The left bellows chamber 76 begins to fill under pneumatic pressure to expand, urging both fluid pumping pistons 26, 28 to the right. This is the pressure stroke of the left bellows and exhaust stroke of the right bellows. This is shown in FIG. 8, which illustrates the second stage or cycle of the pump and shuttle valve.

Figure 8:
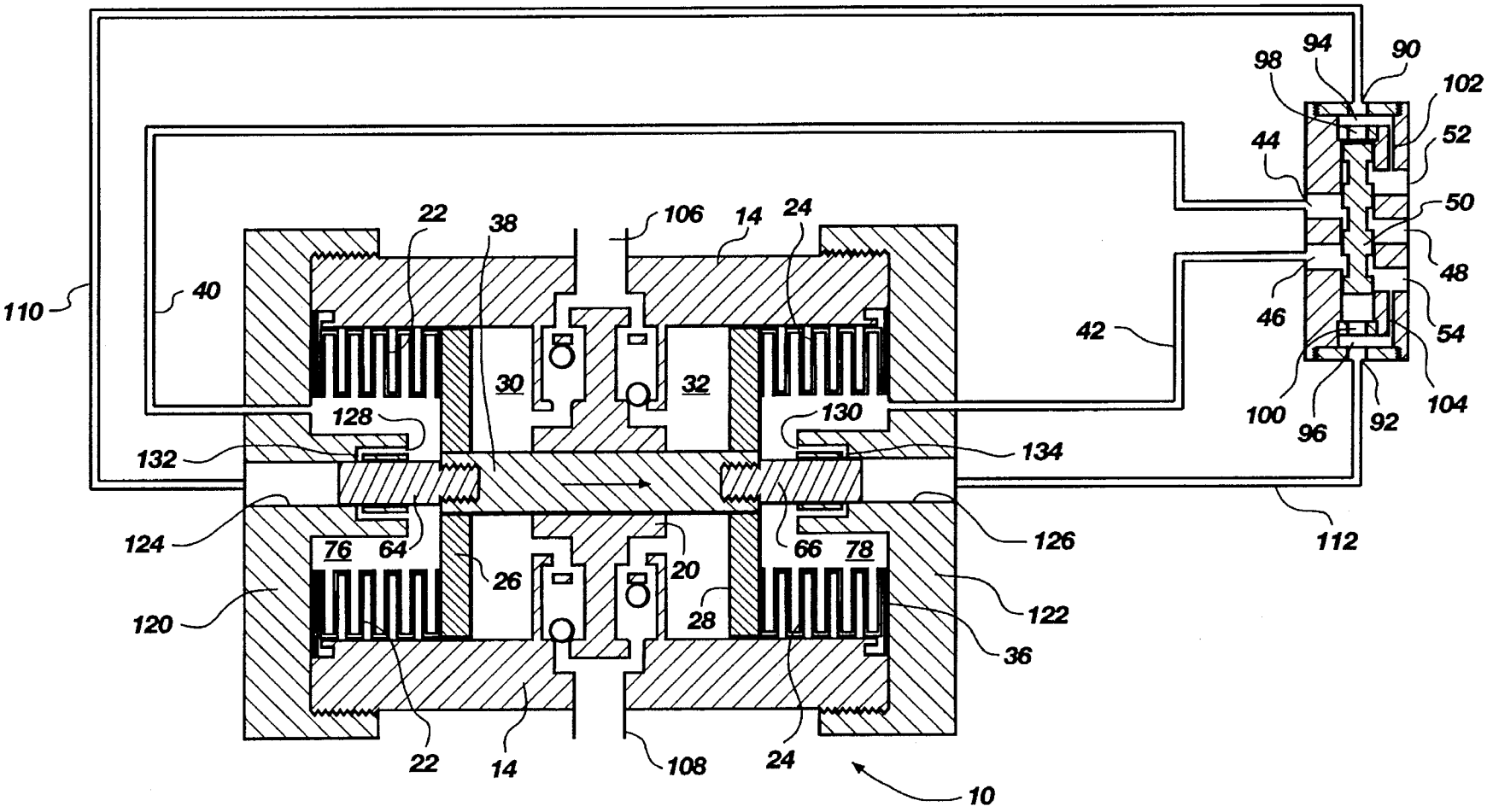
FIG. 8 is a schematic drawing similar to FIG. 7, illustrating the pump and shuttle valve in the second stage of the cycle.

As shown in FIG. 8, the shuttle valve spool 136 remains in its upper position. Rightward movement of the left fluid pumping piston 26 evacuates (pumps) fluid from the left fluid pumping chamber 30, and out the fluid pump exhaust 106. Rightward movement of the right fluid pumping piston 28 draws fluid into the right fluid pumping chamber 32 via the fluid pump intake 108. Rightward movement of the right fluid pumping piston 28 also evacuates the right bellows chamber 78 through the right air fill line 42, the shuttle valve lower air supply port 46, through the shuttle valve, and out the lower exhaust port 54, to atmosphere.

Rightward travel of the left shifting piston 64 with the pumping pistons 26, 28 and connecting rod 38 causes a vacuum to be created within the left shifting cylinder 124. This vacuum is applied through a left shifting line 110 to the shuttle valve left shifting port 90, air chamber 94, and spool port 98, tending to maintain the spool 50 to the upper as shown.

As the left shifting piston 64 travels to the right within its shifting cylinder 124, it uncovers the left annular channel 132, thereby permitting a blast of pressurized air in the left bellows chamber 76, which is in its pressure stroke, to exhaust through the air release holes 128, annular channel 132, and into the interior of the left shifting cylinder 124. This blast of pressurized air exhausts from the left shifting cylinder 124 through the left shifting line 110, the upper shuttle valve shifting port 90, and through the upper air chamber 94 and spool port 98, where it "blasts" the shuttle valve spool 136 to its right position. This "shifts" the shuttle valve and-fluid pump to their third stage or cycle, as is shown in FIG. 9.

In FIG. 9, further pressurized air in the shuttle valve upper air chamber 94 bleeds through the upper exhaust bleed passageway 102 and out the upper exhaust port 52. Because of the restrictive orifice effect of the shuttle valve exhaust bleed passageway 102, this initial blast of pressurized air into the shuttle valve upper shifting chamber 94 is forced into the larger spool port 98 to shift the spool 136 from its upper position to its lower position, before the residual pressurized air is permitted to "bleed" to exhaust through the restrictive exhaust bleed passageway 102 and exhaust port 52.

With the shuttle spool 136 in its lower position (FIG. 9), high pressure air through the inlet port 48 is now directed to the lower air supply port 46, through the right air fill line 42, and into the right bellows chamber 78. At this point, the right bellows 24 is essentially compressed and the bellows chamber 78 is otherwise sealed except for its communication with the right air fill line 42. The right bellows chamber 78 begins to fill under pneumatic pressure to expand, urging both fluid pumping pistons 28, 26 to the left. This is the pressure stroke of the right bellows and exhaust stroke of the left bellows. This is shown in FIG. 10, which illustrates the fourth stage or cycle of the pump and shuttle valve.

As shown in FIG. 10, the shuttle valve spool 136 remains in its lower position. Leftward movement of the right fluid pumping piston 28 evacuates (pumps) fluid from the right fluid pumping chamber 32, and out the fluid pump exhaust 106. Leftward movement of the left fluid pumping piston 26 draws fluid into the left fluid pumping chamber 30 via the fluid pump intake 108. Leftward movement of the left fluid pumping piston 26 also evacuates the left bellows chamber 76 through the left air fill line 40, the shuttle valve upper air supply port 44, through the shuttle valve, and out the upper exhaust port 52, to atmosphere.

Leftward travel of the right shifting piston 66 with the pumping pistons 26, 28 and connecting rod 38 causes a vacuum to be created within the right shifting cylinder 126. This vacuum is applied through a right shifting line 112 to the shuttle valve lower shifting port 92, air chamber 96, and spool port 100, tending to maintain the spool 136 to the lower as shown.

As the right shifting piston 66 travels to the left within its shifting cylinder 126, it uncovers the right annular channel 134, thereby permitting a blast of pressurized air in the right bellows chamber 78 to exhaust through the air release holes 130, annular channel 134, and into the interior of the right shifting cylinder 126. This blast of pressurized air exhausts from the right shifting cylinder 126 through the left shifting line 112, the right shuttle valve shifting port 92, and through the lower air chamber 96 and spool port 100, where it "blasts" the shuttle valve spool 136 to its upper position. This "shifts" the shuttle valve and fluid pump back to their first stage or cycle, as is shown in FIG. 7.

Returning to FIG. 7, further pressurized air in the lower shuttle valve air chamber 96 bleeds through the lower exhaust bleed passageway 104 and out the lower exhaust port 54. Because of the restrictive orifice, effect of the shuttle valve exhaust bleed passageway 104, this initial blast of pressurized air into the shuttle valve lower shifting chamber 96 is forced into the larger spool port 100 to shift the spool 136 from its lower position to its upper position, before the residual pressurized air is permitted to "bleed" to exhaust through the restrictive exhaust bleed passageway 104. At this point in the cycle, the cycle repeats itself with the description of the FIG. 7 first stage of the cycle.

Figure 12:
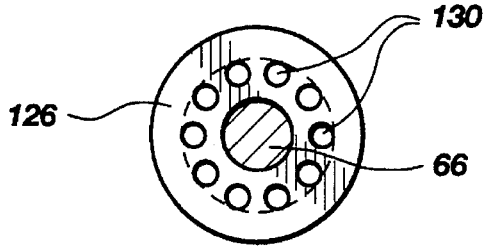
FIG. 12 is a partial view taken along lines 12—12 in FIG. 7, showing the configuration of the shifting ports in the shifting cylinder of the alternative embodiment fluid pump.

FIG. 12 illustrates the placement of the shifting mechanism air release holes 130 around the cylinder interior and shifting piston 66. This configuration accommodates more and larger air release holes, and therefore provides a larger flow area for the pressurized air to "blast" from the bellows chamber 78 into the shifting cylinder 126 and shuttle valve to "blast" the shuttle valve spool to its opposite position.

It should be appreciated that the alternative embodiment reciprocating fluid pump and associated spool valve of FIGS. 7–12 offer a number of improvements over similar prior art devices. The shuttle valve spool 136 of the FIG. 11 shuttle valve incorporates a central air passage defined by the two central valve elements 140 and 142, rather than a single center valve element, as in prior art shuttle valves. By having the two central valve elements, the incoming air pressure into the air inlet port 48 can never impart a side load to the valve spool. Rather, at the instant wherein the valve elements 140 and 142 directly close respective air supply ports 44 and 46, the air pressure-generated force is always directed to opposing insides of the spool valve elements. Therefore, there is never any side load to the shuttle valve spool which could tend to cause the spool to drag and/or wear the valve spool or valve body seals unevenly.

In addition, because the shuttle valve is shifted by the pressurized air blast through the shifting cylinder air release holes, the shuttle valve spool cannot shift until the pump piston diaphragm reaches the end of its stroke. Solids and particle contamination in the air supply cannot prematurely trip mechanical or electronic shuttle valve switches because there are none. Therefore, premature shuttle spool shifting cannot occur, and shuttle valve deadhead is eliminated.

Some fluid pumping applications require a rapid cycling pump. In such applications, the reciprocating pump of FIGS. 7–10 is particularly advantageous because of its shifting cylinder air release holes and annular channel design. Depending on a number of criteria (air temperature, pressure, humidity, velocity, etc.), it is desirable to introduce more pressurized air from the bellows chambers into the shifting cylinders than is permitted by the shifting cylinder shifting port design of FIGS. 1–4. The shifting cylinder air release holes and annular channel design of FIGS. 7–10 can provide a larger cross-sectional area for air flow into the shifting cylinder, thereby permitting more air volume, and at a faster rate, into the cylinder to increase both the speed and smoothness of the shifting of the shuttle valve.

Figure 13:
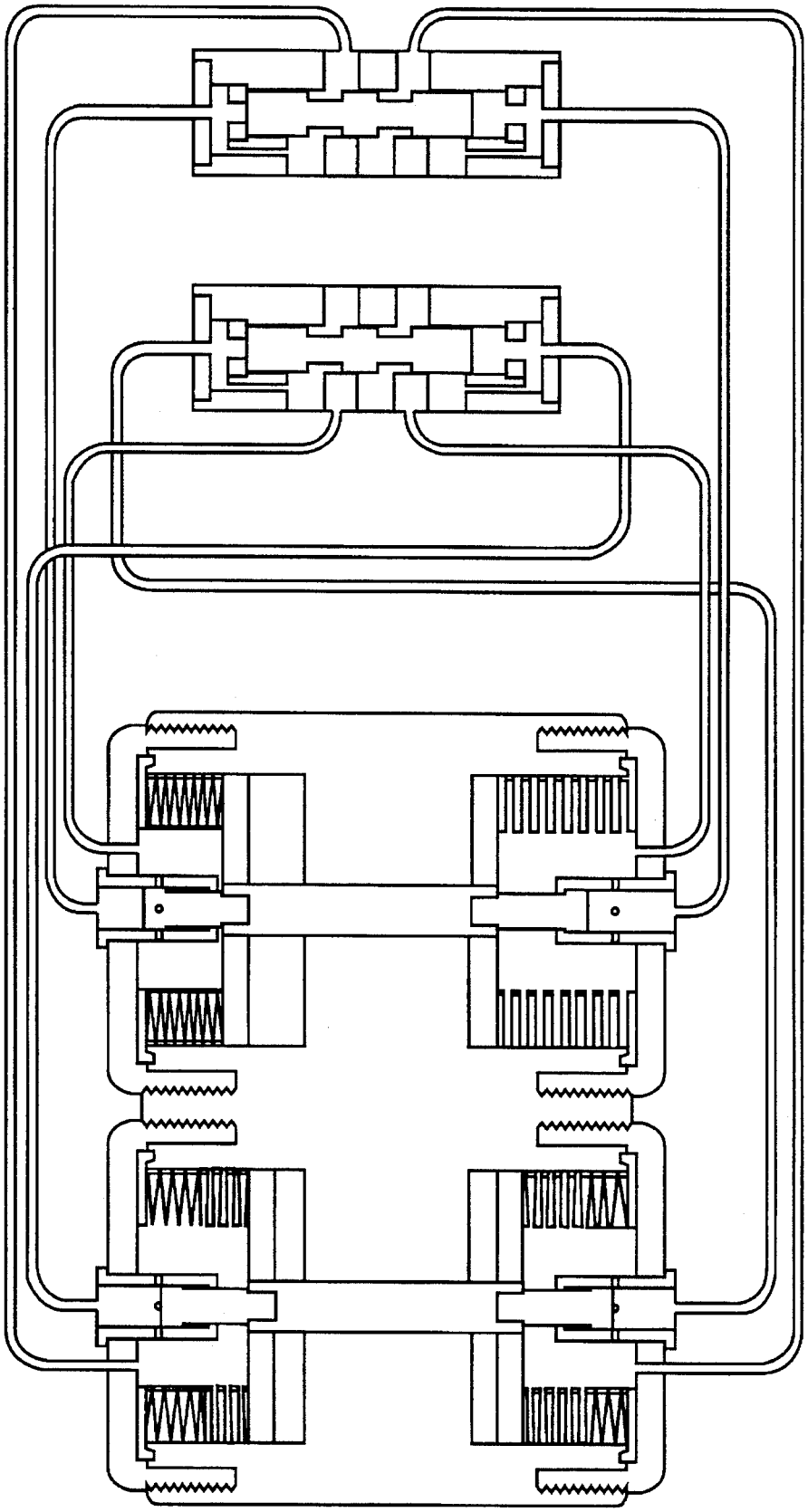
FIG. 13 is a schematic drawing of a system of multiple reciprocating fluid pumps and associated shuttle valves, all shown in section, similar to that illustrated in FIGS. 1–6.

FIG. 13 illustrates the arrangement for a system of multiple reciprocating fluid pumps and associated shuttle valves. Those skilled in the art will appreciate that integrating a system of multiple pumps with staggered and coordinated cycles will further reduce fluid surge in such a system by shifting the pumping (exhaust) cycle of one of the pumps to overlap the point in the cycle of the other pump at which the pumping means is at the end of its stroke, i.e., not pumping. In this manner, a more constant and uniform fluid flow from the multiple pump system is achieved.

FIG. 13 also illustrates that in the multiple pump system, the shuttle valve that controls the pumping cycle of one of the pumps is actually actuated by pressurized air exhaust from the bellows chamber of the other pump. In this manner, in a two-pump, two-shuttle valve system, for instance, coordinated shifting of the two shuttle valves is assured. In addition, the adjustable feature of the piston and cylinder shifting mechanism of FIG. 6 can be utilized in multiple pump systems to further shift the "reciprocating points" in the various pumps, in order to smooth out the pumped fluid output and virtually eliminate all fluid surge within the system.

From the foregoing, it will be seen that this invention is one well adapted to attain all of the ends and objectives herein set forth, together with other advantages which are obvious and which are inherent to the apparatus. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

What is claimed is:

1. A pneumatically shifted reciprocating fluid pump comprising:

a body defining a plurality of pumped fluid pumping chambers;

driving means defining a pneumatically driven driving chamber associated with each of the respective pumped fluid pumping chambers;

connecting means connecting the respective driving means;

a pneumatically actuated control valve for supplying a drive fluid sequentially to each pneumatically actuated driving chamber for effecting reciprocal pumping of the respective driving means; and pneumatically actuated pneumatic switching means associated with each of the respective driving means for permitting drive fluid to selectively exhaust from respective pneumatically actuated driving chambers at a predetermined location on each respective driving means relative to its respective fluid pumping chamber, means the control valve for sequentially supplying the drive fluid to respective pneumatically actuated driving chambers for reciprocally actuating respective pumping means, pneumatic actuated means comprising a piston and cylinder connected to the respective pumping means, wherein the piston is attached to the pumping means, and the cylinder including means defining a drive fluid relief passageway therein for selectively relieving pressurized drive fluid from its associated pneumatically actuated driving chamber.

2. A pneumatically shifted reciprocating fluid pump as set forth in claim 1, connected and wherein the cylinder is mounted to the pump body.

3. A pneumatically shifted reciprocating fluid pump as set forth in claim 1, wherein pneumatically actuated the pneumatic switching means is longitudinally adjustable relative to the location of the pumping means within the pumping chamber.

4. A pneumatically shifted reciprocating fluid pump as set forth in claim 1, including means for allowing the fit between the pneumatic switching means piston and cylinder to be sufficiently loose to permit a desired amount of air by-pass therebetween as the respective associated driving means approaches the end of its pumping stroke.

5. A pneumatically shifted reciprocating fluid pump as set forth in claim 1, wherein pneumatically actuated the pneumatic switching means cylinder includes a plurality of drive fluid relief passageways.

6. A pneumatically shifted reciprocating fluid pump as set forth in claim 5, wherein pneumatically actuated the pneumatic switching means cylinder drive fluid relief passageways are oriented radially in a plane normal to the axis of travel of the pneumatic switching piston within the cylinder.

7. A pneumatically shifted reciprocating fluid pump as set forth in claim 1, wherein the driving means comprises a piston, and the pneumatically driven driving chamber comprises a bellows.

8. A pneumatically shifted reciprocating fluid pump as set forth in claim 1, wherein the pneumatically actuated control valve is physically separate from the fluid pump body.

9. A pneumatically shifted reciprocating fluid pump comprising:

a body defining a plurality of pumped fluid pumping chambers;

driving means defining a pneumatically driven driving chamber associated with each of the respective pumped fluid pumping chambers;

connecting means connecting the respective driving means;

a pneumatically actuated control valve for supplying a drive fluid sequentially to each pneumatically actuated driving chamber for effecting reciprocal pumping of the respective driving means; and pneumatically actuated pneumatic switching means associated with each of the respective driving means for permitting drive fluid to selectively exhaust from respective pneumatically actuated driving chambers at a predetermined location on each respective driving means relative to its respective fluid pumping chamber, to shift the control valve for sequentially supplying the drive fluid to respective pneumatically actuated driving chambers for reciprocally actuating respective pumping means, the pneumatic switching means comprising a piston connected to the respective pumping means and a cylinder mounted to the pump body, the cylinder including means defining a drive fluid relief passageway therein for selectively relieving pressurized drive fluid from its associated pneumatically actuated driving chamber, means for allowing the fit between the pneumatic switching means piston and cylinder to be sufficiently loose to permit a desired amount of air by-pass therebetween as the respective associated driving means approaches the end of its pumping stroke.

10. A pneumatically shifted reciprocating fluid pump as set forth in claim 9, wherein pneumatically actuated the pneumatic switching means is longitudinally adjustable relative to the location of the pumping means within the pumping chamber.

11. A pneumatically shifted reciprocating fluid pump as set forth in claim 9, wherein pneumatically actuated the pneumatic switching means cylinder includes a plurality of drive fluid relief passageways.

12. A pneumatically shifted reciprocating fluid pump as set forth in claim 11, wherein pneumatically actuated the pneumatic switching means cylinder drive fluid relief passageways are oriented radially in a plane normal to the axis of travel of the pneumatic switching piston within the cylinder.

13. A pneumatically shifted reciprocating fluid pump as set forth in claim 9, wherein the driving means comprises a piston, and the pneumatically driven driving chamber comprises a bellows.

14. A pneumatically shifted reciprocating fluid pump as set forth in claim 9, wherein the pneumatically actuated control valve is physically separate from the fluid pump body.

* * * * *

UNITED STATES PATENT AND TRADEMARK OFFICE

CERTIFICATE OF CORRECTION

PATENT NO. : 5,558,506

DATED : September 24, 1996

INVENTOR(S) : John M. Simmons; Tom M. Simmons

It is certified that error appears in the above-identified patent and that said Letters Patent is hereby corrected as shown below:

In column 15, line 26, insert --to shift-- after "means";

In column 15, line 29, replace "pneumatic" with --pneumatically--;

In column 15, line 29, delete "pneumatic actuated" insert-- the pneumatically actuated pneumatic switching--.

In column 15, line 37, delete "connected and";

In column 15, line 40, insert --the-- after "wherein";

In column 15, line 40, delete "the" following "actuated";

In column 15, line 51, insert --the-- after "wherein";

In column 15, line 51, delete "the" following "actuated";

In column 15, line 55, insert --the-- after "wherein";

In column 15, line 55, delete "the" following "actuated";

In column 16, line 23, following "chamber", insert --means--;

In column 16, line 27, following "the", insert --pneumatically actuated--;

In column 16, line 39, insert --the-- after "wherein";

UNITED STATES PATENT AND TRADEMARK OFFICE

CERTIFICATE OF CORRECTION

PATENT NO. : 5,558,506

DATED : September 24, 1996

INVENTOR(S) : John M. Simmons; Tom M. Simmons

It is certified that error appears in the above-identified patent and that said Letters Patent is hereby corrected as shown below:

In column 16, line 39, delete "the" following "actuated";

In column 16, line 44, insert --the-- after "wherein";

In column 16, line 44, delete "the" following "actuated";

In column 16, line 48, insert --the-- after "wherein";

In column 16, line 48, delete "the" following "actuated".

Signed and Sealed this

Eleventh Day of March, 1997

Bruce Lehman

*Attest:*

BRUCE LEHMAN

*Attesting Officer*

*Commissioner of Patents and Trademarks*